US007071143B2

(12) United States Patent
Kenney et al.

(10) Patent No.: US 7,071,143 B2
(45) Date of Patent: Jul. 4, 2006

(54) DIRECT THERMOGRAPHIC MATERIALS WITH IMPROVED PROTECTIVE LAYERS

(75) Inventors: Raymond J. Kenney, Woodbury, MN (US); David G. Foster, West Henrietta, NY (US); David A. Johnson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 261 days.

(21) Appl. No.: 10/767,757

(22) Filed: Jan. 28, 2004

(65) Prior Publication Data

US 2005/0164881 A1 Jul. 28, 2005

(51) Int. Cl.
*B41M 5/40* (2006.01)

(52) U.S. Cl. ..... 503/201; 503/200; 503/212; 503/226

(58) Field of Classification Search ..... 503/200, 503/201, 212, 226
See application file for complete search history.

(56) References Cited

U.S. PATENT DOCUMENTS

| | | | |
|---|---|---|---|
| 3,590,076 | A | 6/1971 | Heintzelman et al. |
| 4,060,569 | A | 11/1977 | Woods et al. |
| 5,536,696 | A | 7/1996 | Horsten et al. |
| 5,759,953 | A | 6/1998 | Defieuw et al. |
| 5,817,598 | A | 10/1998 | Defieuw et al. |
| 6,248,442 | B1 | 6/2001 | Kong et al. |
| 2002/0061820 | A1 | 5/2002 | Takeuchi et al. |

FOREIGN PATENT DOCUMENTS

| | | |
|---|---|---|
| EP | 0 669 875 B1 | 4/1996 |
| EP | 0 775 595 B1 | 9/1999 |

OTHER PUBLICATIONS

U.S. Appl. No. 10/614,378, filed Jul. 7, 2003, titled "Slipping Layer Containing Wax Mixture For Dye-Donor Element Used In Thermal Dye Transfer", by Foster et al.
U.S. Appl. No. 10/614,379, filed Jul. 7, 2003, titled "Slipping Layer For Dye-Donor Element Used In Thermal Dye Transfer", by Foster et al.
U.S. Appl. No. 10/614,600, filed Jul. 7, 2003, titled "Slipping Layer Containing A Branched Olefin For A Dye-Donor Element Used In Thermal Dye Transfer" by Foster et al.

*Primary Examiner*—Bruce H. Hess
(74) *Attorney, Agent, or Firm*—J. Lanny Tucker; Louis M. Leichter

(57) ABSTRACT

Non-photosensitive direct thermographic materials have a support and thermally sensitive imaging layer(s) and an outermost "protective" layer comprising:

(a) a solid polymer derived from one or more olefins and from one or more ethylenically unsaturated polymerizable carboxylic acids or esters or anhydrides thereof, and
(b) a branched α-olefin polymer, and
(c) optionally, an additional wax.

25 Claims, No Drawings

DIRECT THERMOGRAPHIC MATERIALS WITH IMPROVED PROTECTIVE LAYERS

FIELD OF THE INVENTION

This invention relates to non-photosensitive direct thermographic materials having an outermost "protective" layer containing a unique combination of lubricants. The invention also relates to methods of imaging such direct thermographic materials.

BACKGROUND OF THE INVENTION

Silver-containing direct thermographic imaging materials are non-photosensitive materials that are used in a recording process wherein images are generated by the direct application of thermal energy. These materials have been known in the art for many years and generally comprise a support having disposed thereon one or more imaging layers comprising (a) a relatively or completely non-photosensitive source of reducible silver ions, (b) a reducing agent composition (acting as a developer) for the reducible silver ions, and (c) a suitable hydrophilic or hydrophobic binder. Thermographic materials are sometimes called "direct thermal" materials in the art because they are directly imaged by a source of thermal energy without any transfer of the energy or image to another material.

In a typical thermographic construction, the image-forming layers are based on silver salts of long chain fatty acids. The preferred non-photo-sensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent whereby a black-and-white image of elemental silver is formed.

Problem to be Solved

Direct thermographic materials are imaged by contacting them with the thermal printhead of a thermographic recording apparatus such as a thermal printer or thermal facsimile. In such materials, an outermost protective layer is disposed over the imaging layer(s) to prevent damage to the soft emulsion layer, and to prevent sticking to, and to facilitate movement of the thermographic material during contact with the thermal printhead in the imaging apparatus. The thermographic material is then imaged at an elevated temperature, typically in the range of from about 300 to about 400° C. for 50 ms or less, to form a visible image [see for example U.S. Pat. No. 5,759,953 (Defieuw et al.)]. Such protective layers are also known in the art as transport or "slip" layers.

The outermost protective layer of the thermographic materials should be designed to provide smooth transfer into and out of the imaging apparatus under a wide range of imaging (or printing) conditions. Variable print forces along with the length or width of the material and variations in imaging temperatures can cause imaging defects. A deficiency in the performance of the protective layer causes intermittent rather than continuous transport across the thermal printhead.

Various lubricants and matting agents have been incorporated into the outermost protective layers of direct thermographic materials to solve the noted problems. For example, U.S. Pat. No. 5,759,953 (Defieuw et al.), U.S. Pat. No. 5,817,598 (Defieuw et al.), U.S. Pat. No. 5,536,696 (Horsten et al.), EP 0 669 875A1 (Horsten et al.), and EP 0 775 595A1 (Defieuw et al.) describe such components and their use in thermographic materials.

Many of the known lubricants used in thermographic materials are silicone-based lubricants that, while providing excellent protective or transport characteristics, have the disadvantage of providing a slippery feel to the outer surface when handled. Silicone based lubricants are also likely to transfer to the back of stacked films or roll materials, resulting in a loss of lubrication with time. In addition, this mobility at room temperature leads to the formation of ghost images when the thermographic materials are imaged. There has been considerable effort in the industry to find lubricants that solve all of the noted problems without causing other disadvantages.

SUMMARY OF THE INVENTION

The present invention provides a non-photosensitive direct thermographic material comprising a support and on one or both sides thereof, one or more thermally sensitive imaging layers and an outermost non-thermally sensitive protective layer disposed over the one or more thermally sensitive imaging layers, the one or more thermally sensitive layers having in reactive association, a non-photosensitive source of reducible silver ions and a reducing agent for the reducible silver ions, and the outermost protective layer comprising:

(a) a solid polymer derived from one or more olefins and from one or more ethylenically unsaturated polymerizable carboxylic acids or esters or anhydrides thereof, and (b) a branched α-olefin polymer, and (c) optionally, an additional wax, wherein the total amount of component (a), component (b), and optionally component (c) is from about 0.1 to about 2.5 $g/m^2$.

In preferred embodiments, the present invention provides a black-and-white, non-photosensitive direct thermographic material that comprises a transparent polymer support having on only one side thereof one or more thermally sensitive imaging layers and an outermost non-thermally sensitive protective layer over the one or more thermally sensitive imaging layers, the one or more thermally sensitive imaging layers comprising predominantly one or more hydrophobic binders, and in reactive association, a non-photosensitive source of reducible silver ions that includes one or more silver aliphatic carboxylates at least one of which is silver behenate, a reducing agent for the non-photosensitive source reducible silver ions comprising an aromatic di- or tri-hydroxy compound having at least two hydroxy groups in ortho- or para-relationship on the same aromatic nucleus or mixture thereof, and a conductive layer on the opposite side of the support, the outermost protective layer comprising a matting agent in an amount of from about 1 to about 10 weight % of the total dry weight of the outermost protective layer, and the outermost protective layer further comprising all three of the following components (a), (b), and (c):

(a) a polyolefin solid polymer having a molecular weight of about 700, an acid number of 160, a saponification number of 212, a penetration index at 25° C. of 3, a melting point of 78° C., and that is the reaction product of α-olefin with maleic anhydride and mono-isopropyl maleate (commercially available as CERAMER® 1608), (b) a branched α-olefin polymer having a number average molecular weight of about 4400, a softening point of 74° C. (commercially available as VYBAR® 103), and (c) a linear polyethylene wax having a weight average molecular weight of about 450 and a melting point of 81° C. (commercially available as POLYWAX® 400), wherein the weight ratio of component (a) to component (b) is from about 1:2 to about 2:1, the weight ratio of component (a) to component (c) is from about 1:2 to about 2:1, and the weight ratio of component (b) to component (c) is from about 1:2 to about 2:1, and component (a) is present in an amount of from about 0.01 to about 1 $g/m^2$.

The present invention also provides a method comprising imaging the direct thermographic material of the present invention with a thermal imaging source (such as thermal printhead) to provide a visible image.

Where the direct thermographic material comprises a transparent support, the image-forming method can further comprise:

positioning the imaged thermographic material with the visible image thereon between a source of imaging radiation and an imageable material that is sensitive to the imaging radiation, and thereafter exposing the imageable material to the imaging radiation through the visible image in the imaged thermographic material to provide an image in the imageable material.

The method of this invention can be used to provide an imaged direct thermographic material to be used for medical diagnostic purposes.

The present invention provides a particular protective layer composition that includes at least components (a) and (b) described herein, and optionally and preferably, the addition of component (c). This combination of lubricants provides the desired transport properties during and after thermographic imaging.

DETAILED DESCRIPTION OF THE INVENTION

The direct thermographic materials of this invention can be used to provide black-and-white images using non-photosensitive silver salts, reducing agents, binders, and other components known to be useful in such materials.

The direct thermographic materials of this invention can be used in black-and-white thermography and in electronically generated black-and-white hardcopy recording. They can be used as output media, in radiographic imaging (for example digital medical imaging), X-ray radiography, and in industrial radiography. Furthermore, the absorbance of these thermographic materials between 350 and 450 nm is desirably low (less than 0.5), to permit their use in the graphic arts area (for example, in imagesetting and phototypesetting operations), in the manufacture of printing plates, in contact printing, in duplicating ("duping"), and in proofing.

The direct thermographic materials of this invention are particularly useful as output media for medical imaging of human or animal subjects in response to visible or X-radiation. Such applications include, but are not limited to, thoracic imaging, mammography, dental imaging, orthopedic imaging, general medical radiography, therapeutic radiography, veterinary radiography, and auto-radiography.

In the direct thermographic materials of this invention, the components needed for imaging can be in one or more thermally sensitive layers on one side ("frontside") of the support. The layer(s) that contain the non-photosensitive source of reducible silver ions, or both, are referred to herein as thermographic emulsion layer(s) or thermally sensitive imaging layer(s).

Where the materials contain thermographic imaging layers on one side of the support only, various non-imaging layers can be disposed on the "backside" (non-emulsion or non-imaging side) of the materials, including an outermost protective layer and/or a conductive layer.

In such embodiments, various non-imaging layers can also be disposed on the "frontside," imaging, or emulsion side of the support, including primer layers, interlayers, opacifying layers, subbing layers, carrier layers, auxiliary layers, and other layers readily apparent to one skilled in the art.

For some embodiments, the direct thermographic materials may be "double-sided" and have thermographic emulsion coating(s) or thermally sensitive imaging layer(s) on both sides of the support. In such constructions each side can also include one or more primer layers, interlayers, antistatic layers, auxiliary layers, anti-crossover layers, conductive layers, and other layers readily apparent to one skilled in the art. An outermost protective layer can be on either or both sides of the support.

Definitions

As used herein:

In the descriptions of the thermographic materials of the present invention, "a" or "an" component refers to "at least one" of that component (for example, a specific lubricant in the outermost protective layer).

"Thermographic material(s)" means a construction comprising at least one thermographic emulsion layer or thermally sensitive imaging layer(s) wherein the source of reducible silver ions is in one layer and the other essential components or desirable additives are distributed, as desired, in the same layer or in an adjacent coating layer, as well as any supports, topcoat layers, image-receiving layers, carrier layers, blocking layers, conductive layers, subbing or priming layers. These materials have at least one protective layer as described herein. These materials also include multilayer constructions in which one or more imaging components are in different layers, but are in "reactive association." For example, one layer can include the non-photosensitive source of reducible silver ions and another layer can include the reducing agent, but the two reactive components are in reactive association with each other. Such embodiments also include an outermost protective layer over all thermally sensitive layers.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal printheads.

The materials of this invention are "direct" thermographic materials and thermal imaging is carried out in a single thermographic material containing all of the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the reactive components are in the same layer or in adjacent layers so that they readily come into contact with each other during thermal imaging and development.

"Emulsion layer," "imaging layer," or "thermographic emulsion layer," means a thermally sensitive layer of a thermographic material that contains the non-photosensitive source of reducible silver ions. It can also mean a layer of the thermographic material that contains, in addition to the non-photosensitive source of reducible ions, additional desirable components. These layers are usually on what is known as the "frontside" of the support.

The protective layer is the outermost layer on the imaging side of the material that is in direct contact with the imaging means.

Many of the materials used herein are provided as a solution. The term "active ingredient" means the amount or the percentage of the desired material contained in a sample. All amounts listed herein are the amount of active ingredient added unless otherwise specified.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive. The direct thermographic materials of the present invention are non-photosensitive meaning that no photosensitive silver halide(s) has been purposely added.

The sensitometric terms, absorbance, contrast, Dmin, and Dmax have conventional definitions known in the imaging arts. In thermographic materials, Dmin is considered herein as image density in the areas with the minimum application of heat by the thermal printhead. The sensitometric term absorbance is another term for optical density (OD).

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided," "double-faced coating," and "duplitized" are used to define thermographic materials having one or more of the same or different thermally sensitive layers disposed on both sides (frontside and backside) of the support.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group can include ether and thioether groups (for example $CH_3—CH_2—CH_2—O—CH_2—$ and $CH_3—CH_2—CH_2—S—CH_2—$), haloalkyl, nitroalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients would, of course, be excluded by a skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

Non-Photosensitive Source of Reducible Silver Ions

The non-photosensitive source of reducible silver ions used in the direct thermographic materials of this invention can be any metal-organic compound that contains reducible silver (1+) ions. Such compounds are generally silver salts of silver coordinating ligands. Preferably, it is an organic silver salt that is comparatively stable to light and forms a silver image when heated to 50° C. or higher in the presence of a reducing agent. Mixtures of the same or different types of silver salts can be used if desired.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

In some embodiments, a highly crystalline silver behenate can be used as part or all of the non-photosensitive sources of reducible silver ions, as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described in EP 1 158 355A1 (Geuens et al.), incorporated herein by reference.

Other useful but less preferred silver salts include but are not limited to, silver salts of aromatic carboxylic acid and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α-(on a hydrocarbon group) or ortho-(on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazoles and imidazole derivatives as described in U.S. Pat. No. 4,260,677 (Winslow et al.).

It is also convenient to use silver half soaps that are blends of silver carboxylates and carboxylic acids.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.), that is incorporated herein by reference, or as silver dimer compounds that comprise two different silver salts as described in U.S. Pat. No. 6,472,131 (Whitcomb), that is also incorporated herein by reference.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, whitcomb, Howlader, and Leichter) that is incorporated herein by reference.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/$m^2$ of the thermographic material, and preferably from about 0.005 to about 0.05 mol/$m^2$ of that material.

The total amount of silver in the thermographic materials is generally at least 0.001 mol/$m^2$ and preferably from about 0.005 to about 0.05 mol/$m^2$.

Reducing Agents

When used in a thermographic material, the reducing agent (or reducing agent composition comprising two or more components) for the source of reducible silver ions can be any material, preferably an organic material, that can reduce silver (1+) ion to metallic silver. For example, useful reducing agents are organic compounds containing at least one active hydrogen atom linked to an oxygen, nitrogen, or carbon atom. Mixtures of various types of reducing agents can be used if desired.

Conventional photographic developers can be used as reducing agents, including aromatic di- and tri-hydroxy compounds (such as hydro-quinones, gallic acid and gallic acid derivatives, catechols, and pyrogallols), aminophenols, p-phenylenediamines, alkoxynaphthols, pyrazolidin-3-one type reducing agents, pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), and other materials readily apparent to one skilled in the art.

When used with a silver carboxylate silver source in a thermo-graphic material, preferred reducing agents are aromatic di- and tri-hydroxy compounds having at least two hydroxy groups in ortho- or para-relationship on the same aromatic nucleus. Examples are hydroquinone and substituted hydro-quinones, catechols, pyrogallol, gallic acid and gallic acid esters, and tannic acid.

Particularly preferred are catechol-type reducing agents having no more than two hydroxy groups in an ortho-relationship. Preferred catechol-type reducing agents include, for example, catechol, 3-(3,4-dihydroxy-phenyl)-propionic acid, 2,3-dihydroxy-benzoic acid, 2,3-dihydroxy-benzoic acid esters and amides, 3,4-dihydroxy-benzoic acid, and 3,4-dihydroxy-benzoic acid esters and amides.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxybenzoate, ethyl 3,4-dihydroxy-benzoate, butyl 3,4-dihydroxybenzoate, 3,4-dihydroxybenzaldehyde, 3,4-dihydroxybenzonitrile, and phenyl-(3,4-dihydroxyphenyl)ketone. Such compounds are described, for example, in U.S. Pat. No. 5,582,953 (Uyttendaele et al.), that is incorporated herein by reference.

Mixtures of catechol reducing agents with various substituents can be used to optimize reactivity, Dmax, Dmin, and other imaging properties of the thermographic material.

Still another particularly useful class of reducing agents are polyhydroxy spiro-bis-indane compounds that are described in U.S. Pat. No. 3,440,049 (Moede) and as reducing agents in U.S. Pat. No. 5,817,598 (Defieuw et al.), both incorporated herein by reference.

In some constructions, "hindered phenol reducing agents" can be used. Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis (hydroxyphenyl)methanes (that is bisphenols), hindered phenols, and hindered naphthols, each of which may be variously substituted. Representative compounds are described in U.S. Pat. No. 3,094,417 (Workman) and U.S. Pat. No. 5,262,295 (Tanaka et al.), both incorporated herein by reference.

In some instances, the reducing agent composition comprises two or more components such as a catechol or a hindered phenol developer and a co-developer that can be chosen from the various known classes of co-developers. Ternary developer mixtures involving the further addition of contrast enhancing agents are also useful. Such contrast enhancing agents can be chosen from the various classes of reducing agents described below. Useful co-developer reducing agents are as described for example, in U.S. Pat. No. 6,387,605 (Lynch et al.) that is incorporated herein by reference.

Additional classes of reducing agents that can be used as co-developers are trityl hydrazides and formyl phenyl hydrazines as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference.

Additional reducing agents that have been disclosed in dry silver systems including amidoximes, azines, a combination of aliphatic carboxylic acid aryl hydrazides and ascorbic acid, a combination of polyhydroxybenzene and hydroxylamine, a reductone and/or a hydrazine, hydroxamic acids, a combination of azines and sulfonamidophenols, α-cyanophenylacetic acid derivatives, bis-o-naphthols, a combination of bis-o-naphthol and a 1,3-dihydroxybenzene derivative, 5-pyrazolones, reductones, sulfonamidophenol reducing agents, indane-1,3-diones, chromans, 1,4-dihydropyridines, and 3-pyrazolidones.

The reducing agent (or mixture thereof) described herein is generally present as 1 to 10% (dry weight) of the thermographic emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the thermographic emulsion layer coating.

Other Addenda

The direct thermographic materials of this invention can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having $—SO_2CBr_3$ groups as described in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

The direct thermographic materials of this invention may also include one or more thermal solvents (or melt formers). Combinations of these compounds can also be used including a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

The use of "toners" or derivatives thereof that improve the image are highly desirable components of the thermographic materials of this invention. Toners are compounds that when added to the imaging layer shift the color of the image from yellowish-orange to brown-black or blue-black. Generally, one or more toners described herein are present in an amount of from about 0.01% to about 10% (more preferably from about 0.1% to about 10%), based on the total dry weight of the layer in which it is included. Toners may be incorporated in the -thermographic emulsion layer or in an adjacent layer.

Such compounds are well known materials in the art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides, pyrazoline-5-ones, quinazolinone, 1-phenyl-urazole, 3-phenyl-2-pyrazoline-5-one, and 2,4-thiazolidinedione, naphthalimides, cobalt complexes, mercaptans, N-(aminomethyl)aryldicarboximides, a combination of blocked pyrazoles, isothiuronium derivatives, and certain photo-bleach agents, merocyanine dyes, phthalazine and derivatives thereof [such as those described in U.S. Pat. No. 6,146,822 (Asanuma et al.)], phthalazinone and phthalazinone derivatives, or metal salts or these derivatives, a combination of phthalazine (or a derivative thereof) plus one or more phthalic acid derivatives, quinazolinediones, benzoxazine or naphthoxazine derivatives, rhodium complexes functioning not only as tone modifiers but also as sources of halide ion for silver halide formation in-situ, benzoxazine-2,4-diones and naphthoxazine diones as described in U.S. Pat. No. 5,817,598 (noted above), pyrimidines, asym-triazines, and tetraazapentalene derivatives.

Also useful are the phthalazine compounds described in U.S. Pat. No. 6,605,418 (Ramsden et al.), the triazine thione compounds described in copending and commonly assigned U.S. Ser. No. 10/341,754 (filed Jan. 14, 2003 by Lynch, Ulrich, and Skoug), and the heterocyclic disulfide compounds described in copending and commonly assigned U.S. Ser. No. 10/384,244 (filed Mar. 7, 2003 by Lynch and Ulrich), all of which are incorporated herein by reference.

The thermographic materials of this invention can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more polycarboxylic acids and/or anhydrides thereof that are in thermal working relationship with the sources of reducible silver ions in the one or more thermally sensitive imaging layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (noted above).

Binders

The non-photosensitive source of reducible silver ions, the reducing agent, and any other imaging layer additives used in the present invention are generally added to one or more binders that are predominantly (at least 50% by weight of total binders) hydrophobic in nature. Thus, organic solvent-based formulations are generally used to prepare the thermographic materials of this invention. Mixtures of hydrophobic binders can also be used. It is preferred that at least 80% (by weight) of the binders be hydrophobic polymeric materials such as, for example, natural and synthetic resins that are sufficiently polar to hold the other ingredients in solution or suspension.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the names BUTVAR® from Solutia, Inc (St. Louis, Mo.) and PIOLOFORM® from Wacker Chemical Company (Adrian, Mich.), and cellulose ester polymers.

Examples of useful hydrophilic binders that can be used in minor amounts include proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides, and other synthetic or naturally occurring vehicles commonly known for use in aqueous-based photographic emulsions.

Water-dispersible binders including water-dispersible latexes can also be used in minor amounts in the thermographic materials of this invention. Such materials are well known in the art including U.S. Pat. No. 6,096,486 (noted above).

The polymer binder(s) is used in an amount sufficient to carry the components dispersed therein. Generally, one or more binders are used at a level of from about 10% to about $_{90}$% (more preferably from about 20% to about 70%), based on the total dry weight of the layer in which it is included.

It is particularly useful in the direct thermographic materials of this invention to use predominantly (more than 50% by weight of total binder weight) hydrophobic binders in both imaging and non-imaging layers on both sides of the support. In particular, the outermost conductive layers described in more detail below are generally formulated and disposed on the support with one or more hydrophobic binders such as cellulose ester polymer binders. Of these binders, cellulose nitrate, cellulose acetate, cellulose acetate butyrate, and cellulose acetate propionate are preferred.

Support Materials

The direct thermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters or polycarbonates, such as polyethylene terephthalate film.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used.

Protective Layer

As indicated above, the invention is directed to direct thermo-graphic materials having an outermost protective layer on at least the imaging side of the support comprising two or more specific lubricants from designated classes of compounds. The outermost protective layer provides both protective and transport (or "slip") properties.

As noted above, the protective layer used in the thermographic materials of this invention comprise:

(a) one or more solid polymers, each derived from one or more olefins and from one or more ethylenically unsaturated polymerizable carboxylic acids or esters or anhydrides thereof, (b) one or more branched α-olefin polymers, and (c) optionally, one or more additional waxes.

Preferably, all three components (a), (b), and (c) are present in the protective layer.

Component (a) is a solid polymer derived from one or more olefins and from one or more ethylenically unsaturated polymerizable carboxylic acids or ester or anhydrides thereof. Suitable polymers include those described in U.S. Pat. No. 3,590,076 (Heintzelman et al.) that is incorporated herein by reference in its entirety. The number average molecular weight of the solid polymer is generally from about 300 to about 5000. Mixtures of these solid polymers can be used.

More particularly, the solid polymer is a polyolefin derived from one or more α-olefin monomers, preferably each having 2 to 8 carbon atoms. Ethylene and/or propylene are especially preferred monomers.

Suitable ethylenically unsaturated polymerizable carboxylic acid monomers are those having from 3 to 12 carbon atoms, and preferably from 4 to 5 carbon atoms. Monomers that are dicarboxylic acids and anhydrides thereof are preferred. These include maleic acid, ethyl maleic acid, propyl maleic acid, isopropyl maleic acid, fumaric acid, methylene malonic acid, glutaconic acid, itaconic acid, methyl itaconic acid, mesaconic acid, and citraconic acid and their mixtures, as well as the corresponding esters, anhydrides, and mixtures of such acids, esters and anhydrides. Isopropyl maleic acid, esters and anhydrides therefore are especially preferred.

Suitable component (a) polymers can also be represented by the following Structure (I):

(I)

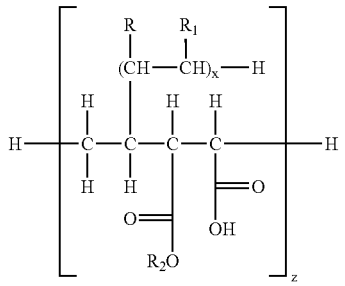

wherein R and $R_1$ independently represent hydrogen or a substituted or unsubstituted alkyl group having 1 to 10 carbon atoms (such as methyl, ethyl, iso-propyl, n-propyl, n-hexyl, t-butyl, and others readily apparent to one skilled in the art). Preferably, R and $R_1$ independently represent hydrogen or a substituted or unsubstituted alkyl groups having 1 to 5 carbon atoms.

$R_2$ is hydrogen or a substituted or unsubstituted alkyl group having 1 to 3 carbon atoms (such as methyl, ethyl, and iso-propyl), x represents a number of from 9 to 75, and "z" is a number of from 5 to 20.

In preferred embodiments, R and $R_1$ are independently methyl or hydrogen, $R_2$ is hydrogen or methyl, "x" is from 3 to 15, and z is from 5 to 14.

For example, component (a) can be a maleic anhydride poly-ethylene, maleic acid anhydride polypropylene, isopropylmaleate polyethylene, or isopropylmaleate polypropylene graft copolymer.

A particularly preferred solid polymer commercially available under the tradename CERAMER® 1608, is a polyolefin that is the reaction product of α-alkenes having more than 10 carbon atoms (preferably about 30 carbon atoms) with maleic anhydride and mono-isopropyl maleate and exhibits a melting point of 78° C. (172° F.). Additional information on this material can be found at the website for CERAMER® 1608: <http://www.bakerhughes.com/baker-petrolite/polymers/olefin_maleic_polymers.htm>.

CERAMER® 1608 polyolefin can be characterized by a molecular weight (gel permeation chromatography) of about 700, an acid number (BWM 3.01A) of 160, a saponification number (BWM 3.01A) of 212 and a penetration index at 25° C. (ASTM 1321) of 3. The molar ratio of α-olefin monomer unit to isopropyl maleate monomer unit in the copolymer is about 1:1. Some units of isopropyl maleate and/or maleic acid anhydride may further be grafted onto the copolymer backbone. Increasing the amount of acid (isopropyl maleate) favors formation of graft copolymers.

Component (b) is a branched α-olefin polymer or mixtures thereof. This branched hydrocarbon typically has a number average molecular weight (as measured by vapor pressure osmometry) of at least 300, preferably at least 400, and more preferably at least 500. It typically has a number average molecular weight of no more than 10,000, preferably no more than 5,000, and more preferably no more than 3,000, although the molecular weight can be outside of these ranges. The branched hydrocarbon typically has a melting point (for crystalline materials) or a softening point (for amorphous or semi-crystalline materials) of at least 30° C., preferably at least 35° C., and more preferably at least 50° C., and typically has a melting point or softening point of no more than 120° C., preferably no more than 110° C., and more preferably no more than 100° C., although the melting point can be outside of these ranges. The degree of branching (or average number of branches per molecule) in the branched hydrocarbon typically is from about 4 to about 5, and typically is no more than about 15, and preferably no more than about 10, although the degree of branching can be outside of these ranges. The branched hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols.

Also suitable are homopolymers and copolymers prepared from monomers of the formula $R_3CH{=}CH_2$ wherein $R_3$ is a substituted or unsubstituted alkyl group having from 1 to 18 carbon atoms, and preferably from 3 to 12 carbon atoms, although the number of carbon atoms can be outside of these ranges. The polymerized α-olefin used as component (b) in this invention is also known as an olefin-derived hydrocarbon polymer or catalytically polymerized α-olefin.

The component (b) branched α-olefin polymers can be represented by the following Structure II:

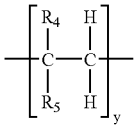

(II)

where $R_4$ is a substituted or unsubstituted alkyl group having 4 to 50 carbon atoms and preferably 18 to 40 carbon atoms. These alkyl groups can be branched or unbranched. $R_5$ is hydrogen or a substituted or unsubstituted alkyl group having 6 to 50 carbon atoms. Preferably $R_5$ is hydrogen. In addition, "y" is a number of from 10 to 500.

These polymers can be prepared using for example, the polymerization process described in U.S. Pat. No. 4,060,569 (Woods et al.) that is incorporated herein by reference. The α-olefin monomer(s) is polymerized in the presence of a free radical catalyst such as a peroxide or hydroperoxide. The molar ratio of free radical catalyst to α-olefin is from about 0.005 to about 0.35. The polymerization is carried out at low pressures sufficient to prevent vaporization of the free radical or α-olefin. The polymerization temperature is typically set such that the free radical catalyst would have a half-life between 0.5 and 3 hours (for example in a range from about 40° C. to about 250° C.).

The poly(α-olefins) used as component (b) are characterized in that they have higher viscosities and greater hardness but lower melting and congealing points than the α-olefin monomers from which they are derived. This is in contrast to typical hydrocarbon polymers that have higher viscosities and greater hardness but also higher melting and congealing points than the hydrocarbon monomers from which they are derived. Because of their relatively low molecular weights, the polymerized α-olefins are also known as polymeric waxes or polymerized α-olefin waxes.

Some polymerized α-olefins are commercially available for example, from the Baker Petrolite Corporation (Sugar Land, Tex.) under the tradename VYBAR®, that is available in solid (for example VYBAR® 103, VYBAR® 260) or liquid (for example VYBAR® 825) form. The use of the solid polymer is preferred.

VYBAR® is a polymerized α-olefin prepared by polymerizing α-olefins under free radical conditions at low pressures. The polymers are unique in that although α-olefin polymers generally have higher molecular weight, greater viscosity and greater hardness than the starting monomer, VYBAR® polymers generally have lower melting points and congealing points than the starting monomer. The monomers employed are primarily α-olefins of the formula where $R_4$ is an alkyl group having from 4 to 50 carbon atoms or is a mixture of α-olefins, vinylidene compounds, internal olefins, and saturated hydrocarbons. Because α-olefins are primarily employed as the monomers used to prepare these polymers, this term is often used to indicate both α-olefins and mixtures of various combinations of α-olefins, vinylidenes, internal olefins, and saturated hydrocarbons.

Examples of suitable branched hydrocarbons include VYBAR® 253, a poly(α-olefin) having a number average molecular weight of about 520, a softening point of about 67° C. (measured by ASTM method D36) and a degree of branching of from about 5 to about 10. This polymer is based on an ethylene structure having pendant hydrocarbon side chains and is also referred to as a poly(α-olefin) or a poly(1-alkene). Also suitable for use in this invention are VYBAR® 103 having a number average molecular weight of about 4400, VYBAR® 260 having a number average molecular weight of about 2,600, and the VYBAR® X-series polymers, such as X-6044, X-6059, and X-6028. Also useful are oxidized hydrocarbons such as those available from Baker Petrolite Corp. as polyethylene-based oxidized materials and microcrystalline-based oxidized materials, such as the CARDIS® and PETRONAUBA® materials.

A particularly preferred branched polyolefin is VYBAR® 103, CAS [68527-08-2] that is described as alkenes, macromonomers with greater than 10 carbon atoms that are α-polymerized and having a softening point of 74° C. (165.2° F.). Additional information for this material can be found at the website for VYBAR® 103: <http://www.bakerhughes.com/bakerpetrolite/polymers/vybar/index.htm>.

The optional but preferred third component (c) in the protective layer is an "additional" wax that is any suitable wax that will form a hydrophobic coating and can be blended with the branched α-olefin. Thus, animal, vegetable, mineral and synthetic waxes may be employed, as may be mixtures thereof.

Generally speaking, a wax is a substance that is a solid at ambient temperature and that has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* (5th Edition), page 628, hereby incorporated by reference. Waxes differ from fats in that fats are esters of trihydric lower alcohols.

The following components are illustrative types of both synthetically prepared and naturally occurring waxes that may be employed in the present invention as component (c):

Useful mineral waxes include but are not limited to paraffin (26–30 carbon atom aliphatic hydrocarbons), microcrystalline waxes (41–50 carbon atom branched chain hydrocarbons), oxidized microcrystalline waxes (hydrocarbons, esters, fatty acids), montan (waxing acids, alcohols, ester, and ketones), Hoechst waxes (oxidized montan wax), and ozokerite waxes (high molecular weight aliphatic and alkenyl hydrocarbons).

Useful vegetable waxes include but are not limited to, carnauba wax (complex alcohols and hydrocarbons), esparto, flax, and sugarcane waxes (fatty acid esters, aldehydes, esters, alcohols, hydrocarbons), and candelilla waxes (hydrocarbons, acids, esters, alcohols, and lactones).

Useful animal waxes include but are not limited to beeswax.

Useful synthetic waxes include but are not limited to polyolefins derived from one or more olefins.

One preferred additional wax is the fully saturated homopolymer of a low molecular weight polyethylene (such as a low molecular weight polyolefin), or copolymers of various alkene monomers that form polymers with a molecular weight at or below 3,000, a melting point below 130° C., and low melt viscosities. Applicable waxes could include POLYWAX® that is available from Baker Petrolite Corp.

In preferred embodiments, component (c) is a microcrystalline wax, carnauba wax, petronauba wax, paraffin wax, candelilla wax, or a linear low molecular weight polyethylene.

POLYWAX® is a linear polyethylene wax. A particularly preferred wax is POLYWAX® 400, CAS [9002-88-4], described as polyethylene homopolymer with weight average molecular weight of about 450 and a melting point of 81° C. (177.8° F.). Additional information on this material can be found at the website for POLYWAX® 400: <http/www.bakerhughes.com/bakerpetrolite/polymers/ethylene-_homopolymers.htm>.

The total amount of components (a), (b), and optionally (c) that is present in the thermographic materials protective layer is generally of from about 0.1 to about 2.5 g/m$^2$ and preferably from about 0.15 to about 1 g/m$^2$, with or without a binder. Preferably, all three components are used in the protective layer.

The amount of component (a) in the thermographic materials of this invention is at least 0.01 g/m$^2$ and up to 1 g/m$^2$ (preferably from about 0.1 to about 0.7 g/m$^2$). In addition, the weight ratio of component (a) to component (b) is from about 1:10 to about 10:1 (preferably from about 1:2 to about 2:1). When component (c) is present, the weight ratio of component (a) to component (c) is from about 1:10 to about 10:1 (preferably from about 1:2 to about 2:1), and the weight ratio of component (b) to component (c) is from about 1:10 to about 10:1 (preferably from about 1:2 to about 2:1).

One or more binders may also be used in the protective layer of the thermographic materials. In preferred embodiments, polymeric thermoplastic binders are employed. Examples of such materials include but are not limited to, poly(styrene-co-acrylonitrile) (for example a 70/30 monomer weight ratio), poly(vinyl alcohol-co-butyral) (available commercially as BUTVAR® B-76 or PIOLOFORM® BS-18), poly(vinyl alcohol-co-acetal), poly(vinyl alcohol-co-benzal), polystyrene, poly(vinyl acetate), cellulose acetate butyrate (available commercially as CAB 171-15S), cellulose acetate propionate, cellulose acetate, ethyl cellulose, cellulose triacetate, poly(methyl methacrylate), and copolymers derived from methyl methacrylate. In preferred embodiments of the invention, the binder is CAB 171-15S or PIOLOFORM® BS-18.

The amount of the binder(s) present in the protective layer is generally in an amount of from about 50 to about 95 weight % of the total protective layer.

The protective layer can also contain matting agents such as starch, titanium dioxide, zinc oxide, silica, calcium carbonate, and polymeric beads including beads of the type described in U.S. Pat. No. 2,992,101 (Jelley et al.) and U.S. Pat. No. 2,701,245 (Lynn). The matting agents can be composed of any useful material and may have a size in relation to the protective layer thickness that enables them to protrude through the outer surface of the protective layer, as described for example, in U.S. Pat. No. 5,536,696 (Horsten et al.). If matting agents are present, they generally comprise from about 0.2 to about 10 dry weight % of the protective layer.

Polymeric fluorinated surfactants may also be useful in the protective layer as described in U.S. Pat. No. 5,468,603 (Kub).

In addition, nanometer size particles can be used as reinforcing agents in the protective layer. Such particles are described in for example, copending and commonly assigned U.S. Ser. No. 10/408,393 (filed Apr. 7, 2003 by Pham,) that is incorporated herein by reference.

In general, the outermost protective layer has a dry thickness of from about 0.1 to about 10 μm. Preferably the protective layer dry thickness is from about 1 to about 6 μm.

Thermographic Formulations and Constructions

An organic-based formulation for the thermographic emulsion layer(s) can be prepared by dissolving and dispersing the binder, the source of non-photosensitive silver ions, the reducing agent, and optional addenda in an organic solvent, such as toluene, 2-butanone (methyl ethyl ketone), acetone, or tetrahydrofuran (or mixtures thereof).

The thermographic materials of this invention can be constructed of two or more layers on the imaging side of the support. Two-layer materials would include a single imaging layer and an outermost protective layer. The single imaging layer would contain the non-photosensitive source of reducible silver ions, the reducing agent, the binder, as well as optional materials such as toners, coating aids, and other adjuvants.

Three-layer constructions comprising two imaging layer coatings containing the ingredients and an outermost protective are generally found on the frontside of the materials of this invention.

Layers to promote adhesion of one layer to another in thermo-graphic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), and in copending and commonly assigned U.S. Ser. No. 10/351,814 (filed Jan. 27, 2003 by Hunt), all incorporated herein by reference.

Layer formulations described herein can be coated by various coating procedures including wire wound rod coating, dip coating, air knife coating, curtain coating, slide coating, or extrusion coating using hoppers of the type described in U.S. Pat. No. 2,681,294 (Beguin). The formulations can be coated one at a time, or two or more formulations can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford).

When the layers are coated simultaneously using various coating techniques, a "carrier" layer formulation comprising a single-phase mixture of the two or more polymers described above may be used as described in U.S. Pat. No. 6,436,622 (Geisler), incorporated herein by reference.

Mottle and other surface anomalies can be reduced in the materials of this invention by incorporation of a fluorinated polymer as described in U.S. Pat. No. 5,532,121 (Yonkoski et al.) or by using particular drying techniques as described in U.S. Pat. No. 5,621,983 (Ludemann et al.).

Preferably, two or more layers are applied to a film support using slide coating for example by coating the first layer on top of the second layer while the second layer is still wet using the same or different coating fluids or solvent mixtures.

While the first and second layers can be coated on one side of the film support, manufacturing methods can also include forming on the opposing or backside of said polymeric support, one or more additional layers, including an outermost "protective" layer.

Preferred embodiments include a conductive layer on one or both sides of the support, and more preferably on the backside of the support. Various conductive materials are known in the art such as soluble salts, evaporated metal layers, or ionic polymers such as those described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), and electrically-conductive metal-containing particles dispersed in a polymeric binder as described in EP 0 678 776A1 (Melpolder et al.). In addition, fluorochemicals such as FLUORAD® FC-135 (3M Corporation), ZONYL® FSN (E.I. DuPont de Nemours & Co.), as well as those described in U.S. Pat. No. 5,674,671 (Brandon et al.), U.S. Pat. No. 6,287,754 (Melpolder et al.), U.S. Pat. No. 4,975,363 (Cavallo et al.), U.S. Pat. No. 6,171,707 (Gomez et al.), in U.S. Published Application 2003-0198901 (Sakizadeh et al.), and in copending and commonly assigned U.S. Ser. No. 10/265,058 (filed Oct. 10, 2002 by Sakizadeh, LaBelle, and Bhave).

In most preferred embodiments, the conductive layer includes one or more specific non-acicular metal antimonate particles having a composition represented by the following Structure III or IV:

$$M^{+2}Sb^{+5}{}_2O_6 \quad \text{(III)}$$

wherein M is zinc, nickel, magnesium, iron, copper, manganese, or cobalt, $$M_a{}^{+3}Sb^{+5}O_4 \quad \text{(IV)}$$

wherein $M_a$ is indium, aluminum, scandium, chromium, iron, or gallium.

Preferably, the non-acicular metal antimonate particles are composed of $ZnSb_2O_6$. Several conductive metal antimonates are commercially available from Nissan Chemical Industry, Ltd. (Japan) including the preferred $ZnSb_2O_6$ non-acicular particles that are available as a 40% (solids) solution under the tradename CELNAX® 401M.

Alternatively, the metal antimonate particles can be prepared using methods described in U.S. Pat. No. 5,457,013 (noted above) and references cited therein.

The metal antimonate particles in the conductive layer are predominately (more than 50% by weight of total particles) in the form of non-acicular particles as opposed to "acicular" particles. By "non-acicular" particles is meant not needle-like, that is, not acicular.

The non-acicular metal antimonate particles generally comprise from about 40 to about 55% (preferably from about 40 to about 50%) by weight of the conductive layer. Another way of defining the amount of particles is that they are generally present in the conductive layer in an amount of from about 0.05 to about 3 g/m$^2$ and preferably in an amount of from about 0.15 to about 2 g/m$^2$. Mixtures of different types of non-acicular metal antimonate particles can be used if desired.

The conductive layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents.

As noted above, the conductive layer also includes one or more binder materials that are usually polymers that are generally soluble or dispersible in the organic solvents noted above. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred.

Imaging/Development

The direct thermographic materials of the present invention can be imaged in any suitable manner consistent with the type of material using any suitable source of thermal energy. The image may be "written" simultaneously with development at a suitable temperature using a thermal stylus, a thermal print head, or a laser, or by heating the material as it is moved while in contact with a heat absorbing material. The thermographic materials may include a dye (such as an IR-absorbing dye) to facilitate direct development by exposure to laser radiation. The dye converts absorbed radiation to heat.

Use as a Photomask

The direct thermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials affords a visible image. The thermographic materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photo-polymer, diazo material, photoresist, or photosensitive printing plate. Exposing the imageable material to the imaging radiation through the visible image in the -thermographic material provides an image in the imageable material. This method is particularly useful where the imageable medium comprises a printing plate and the thermographic material serves as an imagesetting film.

Thus, the present invention provides a method for the formation of a visible image (usually a black-and-white image) by thermal imaging of the inventive direct thermographic material. This image may be useful for medical diagnosis.

The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee Wis.) unless otherwise specified. All percentages are by weight unless otherwise indicated.

ALBACAR 5970 is a 1.9 μm precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15S and CAB 381-20 are cellulose acetate butyrate resins available from Eastman Chemical Co. (Kingsport, Tenn.).

CELNAX® CX-Z401M is a 40% organosol dispersion of non-acicular zinc antimonate particles in methanol. It was obtained from Nissan Chemical America Corporation (Houston, Tex.).

DESMODUR® CB55N is a 55% solids solution of an adduct of toluenediisocyanate and is available from Bayer Chemicals Corporation (Pittsburgh, Pa.).

DESMORAPID® PP is a tertiary amine catalyst available from Bayer Chemicals Corporation (Pittsburgh, Pa.).

Dow Corning 550 (DC-550) is a trimethyl terminated dimethyl, phenylmethyl siloxane available from Dow Corning (Midland, Mich.).

MEK is methyl ethyl ketone (or 2-butanone).

PARALOID® A-21 is an acrylic copolymer available from Rohm and Haas (Philadelphia, Pa.).

PIOLOFORM® BL-16 is a polyvinyl butyral resin available from Wacker Polymer Systems (Adrian, Mich.).

PIOLOFORM® BS-18 is a polyvinyl butyral resin available from Wacker Polymer Systems (Adrian, Mich.).

PS512 is an aminopropyldimethyl terminated polydimethylsiloxane available from United Chemical Technologies (Bristol, Pa.).

VITEL® PE 5833B is a polyester resin available from Bostik, Inc. (Middleton, Mass.).

Densitometry Measurements:

Densitometry measurements were made on a custom built computer-scanned densitometer and meeting ISO Standards 5-2 and 5-3. They are believed to be comparable to measurements from commercially available densitometers. Density of the wedges was then measured with a computer densitometer using a filter appropriate to the sensitivity of the thermographic material to obtain graphs of density versus log exposure (that is, D log E curves).

The following examples demonstrate the use of the protective layers described for the invention as protective topcoat layers on the frontside of thermographic materials.

EXAMPLE 1

This example shows the superiority of the protective layer according to the present invention in terms of preventing sticking and providing smooth transfer of the imaging material across the thermal printhead. A defect or deficiency in the performance of that layer causes intermittent rather than continuous transport across the thermal printhead. The silver image thus formed does not appear as a uniform area, but rather as a series of alternating light and dark bands.

Smooth transfer across a wide range of printing conditions is another desirable performance characteristic for a protective layer. Variable print forces along either the length or the width of a print could cause image defects.

Preparation of Backside Conductive Antistatic Coatings:

Backside Undercoat Formulation:

A backside undercoat non-conductive layer formulation was prepared by mixing the following materials:

| | |
|---|---|
| MEK | 94.5 parts |
| CAB 381-20 | 4.4 parts |
| VITEL ® PE-2700B LMW | 1.1 parts |

Backside Topcoat Formulation:

A backside topcoat formulation was prepared by mixing the following materials:

| | |
|---|---|
| MEK | 87.72 parts |
| CAB 381-20 | 10.98 parts |
| SYLOID ® 74X6000 | 0.14 parts |
| L-9342 at 75% solids (containing 75% active solids) | 1.16 parts. |

The backside undercoat non-conductive layer formulation and backside topcoat formulation were coated onto one side of a 7 mil (178 μm) blue tinted poly(ethylene terephthalate) support. A precision multilayer coater equipped with an in-line dryer was used. The coating weight of the backside non-conductive layer was 0.025 g/ft$^2$ (0.27 g/m$^2$) and that of the backside conductive topcoat layer was 0.4 g/ft$^2$ (4.3 g/m$^2$).

Preparation of Frontside Thermographic Coatings:

Silver Soap Homogenate Formulation:

A silver soap thermographic homogenate formulation was prepared with the following components.

| | |
|---|---|
| MEK | 75.5 parts |
| Silver Behenate | 24.0 parts |
| PIOLOFORM ® BL-16 | 0.5 parts |

The materials were mixed and homogenized by passing twice through a homogenizer at 5000 psi (352 kg/cm$^2$). The materials were cooled between the two passes.

Thermographic Emulsion Formulation:

To 76.36 g of the silver behenate homogenate at 24.5% solids was added 151.81 g of MEK followed by 63.8 g of BUTVAR® B-79. The resulting dispersion was stirred for one hour at 1300 rpm. To this dispersion was added 2.89 g of phthalazinone. Stirring for 15 minutes was followed by addition of 5.14 g of 2,3-dihydroxybenzoic acid. Stirring was maintained for an additional 15 minutes.

Thermographic Protective Layer Formulation:

The following stock solution of protective layer formulation was prepared.

| | |
|---|---|
| MEK | 83.09 parts |
| CAB 171-15S | 13.95 parts |
| PARALOID ® A-21 | 1.90 parts |
| ALBACAR ® 5970 | 1.06 parts |

The resulting stock protective layer formulation contained 16.9% solids.

The following lubricant solutions were added to 54.523 g aliquots of the stock protective layer formulation:

TABLE I

| | Sample | | | | | | |
|---|---|---|---|---|---|---|---|
| Material | 1-1 | 1-2 | 1-3 | 1-4 | 1-5 | 1-6 | 1-7 |
| Toluene | 44.113 g | 44.113 g | 44.113 g | 44.113 g | 44.113 g | 44.113 g | 44.113 g |
| POLYWAX ® 400 | — | — | 1.365 g | 0.682 g | — | 0.682 g | 0.455 g |
| CERAMER ® 1608 | 0.682 g | — | — | — | 1.365 | 0.682 g | 0.455 g |

TABLE I-continued

| Material | Sample 1-1 | 1-2 | 1-3 | 1-4 | 1-5 | 1-6 | 1-7 |
|---|---|---|---|---|---|---|---|
| VYBAR ® 103 | 0.682 g | 1.365 g | — | 0.682 g | — | — | 0.455 g |

Preparation of Comparative Sample 1-8:

Comparative Frontside Protective Layer Formulation: The following comparative protective layer formulation was prepared.

| | |
|---|---|
| MEK | 90.96 parts |
| CAB 171-15S | 7.26 parts |
| PARALOID ® A-21 | 0.99 parts |
| ALBACAR ® 5970 | 0.55 parts |
| PS-512 | 0.24 parts |

Thermographic emulsion and protective layer formulations of Samples 1-1 to 1-8 were coated onto the 7 mil (178 μm) blue tinted polyethylene terephthalate support having the backside conductive antistatic layer prepared above. A conventional, laboratory scale, dual-knife coater was used. Samples were dried in an oven at 185° F. (85° C.) for 4 minutes. The coating weight of the thermographic emulsion layer was 2.4 g/ft$^2$ (25.8 g/m$^2$). The coating weight of the topcoat layer was 0.4 g/ft$^2$ (4.3 g/m$^2$).

Evaluation of Samples

Thermographic materials of Samples 1-1 to 1-8 were tested to determine the force needed to transport the materials past a thermal printhead.

A sample of each material was nipped between an 18 mm diameter rubber roller driven by a stepper motor and a Kyocera 12 dot/mm thermal printhead. The back of the thermal printhead was attached to a heat sink maintained at 35° C. The front of the thermal printhead was in contact with the protective layer on the "frontside" of the sample with a force of 54.5 Newtons pushing it against the rubber roller.

The imaging electronics were activated causing the sample to be drawn between the printhead and roller. At the same time the resistive elements in the thermal printhead pulsed for 64 μsec/pulse at 67 μsec intervals during the 17.1 msec/dot printing time. A stepped density (step wedge) was generated by incrementally increasing the number of pulses/dot from 85 to 255 (Dmin to Dmax). The voltage supplied to the printhead was approximately 14.5 Volts. This gave a maximum total energy of approximately 1.45 mJ/dot.

The test pattern consisted of a series of wide bars followed by a series of narrow bars. An initial wide bar of high density (Dmax) was printed to warm up the printhead followed by a second wide bar at low density (Toe density). The test pattern continued with a third wide bar at high density (Dmax) followed by a fourth wide bar at minimum density (Dmin). This was followed by a series of thin bars of alternating Dmax and Dmin.

As each area test pattern of given density is generated, the force required to draw the sample through the print nip was measured with a MCRT Torquemeter [Model 3-08T(16-1), 160 oz-in range] obtained from S. Himmelstein and Co. (Hoffman Estates, IL). Torque data was recorded for Dmin, Toe, and Dmax density as noted above.

Toe Density force is the average force reading within the first wide low density bar. Dmax force is the average force reading within the second wide Dmax bar. Dmin force is the force reading of the wide bar at Dmin following the second Dmax bar. Low force values, as well as similar force values across all density patches are desired in order to maintain even contact of the printhead to the thermographic material. It is desirable for the force values to be less than 3.5 pounds (15.6 N).

TABLE II below shows the force gauge testing results for various protective topcoat formulations. Samples 1-1,1-6, 1-7, and 1-8 meet the force requirements of less than 3.5 pounds (15.6 N).

TABLE II

| Sample | Comparative/ Inventive | Dmin Force Pounds (Newtons) | Toe Force Pounds (Newtons) | Dmax Force Pounds (Newtons) |
|---|---|---|---|---|
| 1-1 | I | 3.29 (14.63) | 2.86 (12.72) | 1.7 (7.56) |
| 1-2 | C | 3.07 (13.66) | 3.34 (14.86) | 4.86 (21.62) |
| 1-3 | C | 4.2 (18.68) | 3.97 (17.66) | 4.36 (19.39) |
| 1-4 | C | 3.61 (16.06) | 3.53 (15.70) | 4.35 (19.35) |
| 1-5 | C | 4.36 (19.39) | 3.86 (17.17) | 1.96 (8.72) |
| 1-6 | I | 2.84 (12.63) | 2.57 (11.43) | 1.6 (7.12) |
| 1-7 | I | 2.3 (10.23) | 2.16 (9.61) | 1.39 (6.18) |
| 1-8 | C | 2.43 (10.81) | 2.61 (11.61) | 2.08 (9.25) |

A second requirement for a topcoat for a thermographic material is a low amount of ghosting (or "ghost image"). Ghosting occurs when, after a section of resistive elements in the thermal printhead prints a dark pattern, a lower density is observed than in adjacent areas where the resistive elements did not print. This shows up as adjacent areas of different densities and is readily noticeable.

Thermographic materials Samples 1-1 to 1-8 were tested to determine their susceptibility to ghosting. Samples were imaged using an AGFA DryStar™ Model 2000 printer. A test pattern consisting of alternating Dmin and Dmax bars along the path of sample travel was used to evaluate the ghost image or "memory" effect. These bars were formed by allowing a number of adjacent resistive elements to be in the "on" mode while an adjacent section of resistive elements was in the "off" mode. Immediately after 6 cm of printing, all resistive elements of the thermal printhead were programmed to print in a neutral gray. The degree to which the prior density pattern was observed in the neutral gray area was graded on the following scale:

| Rating | Comment |
|---|---|
| 1 | Significant density pattern in the neutral gray area. |
| 2 | Easily identified bars. |
| 3 | Bars just distinguishable throughout gray area. |
| 4 | Light and dark bars just distinguishable but disappear within 1 cm. |
| 5 | Imperceptible, only neutral gray observed. |

The results, shown below in TABLE III, demonstrate that the protective layers used in Samples 1-1 to 1-7 performed better than 1-8 (containing PS512, a silicone) in reducing the amount of "ghost image."

TABLE III

| Sample | Rating |
|---|---|
| 1-1 | 5 |
| 1-2 | 5 |
| 1-3 | 5 |
| 1-4 | 5 |
| 1-5 | 4 |
| 1-6 | 5 |
| 1-7 | 5 |
| 1-8 | 2 |

EXAMPLE 2

The following example shows the improvement in retaining the force characteristics (that is, the transport properties of the protective layer) when thermographic samples were subjected to accelerated aging.

The following inventive protective layer solutions were prepared:

Sample 2-1 was prepared in an identical manner to Sample 1-1 above.

Sample 2-2 was prepared in an identical manner to Sample 1-1 above except that poly α-olefin X-6112 (Baker Petrolite) was used in place of VYBAR® 103.

Comparative Sample A was prepared in an identical manner to Sample 1-8.

The initial Dmax force was measured, followed by storage of the samples in an environmental chamber for seven days at 120° F./50% RH to simulate the effects of long-term aging. The Dmax force was again measured.

The results, shown below in TABLE IV, demonstrate that inventive Samples 2-1 and 2-2 had a lower change in Dmax force (Δ) when compared to Comparative Sample A. This indicates that upon natural aging, the inventive materials will lose less lubrication with time compared to the comparative sample.

TABLE IV

| Sample | Initial Dmax Force Pounds (Newtons) | Final Dmax Force Pounds (Newtons) | Δ Dmax Force Pounds (Newtons) |
|---|---|---|---|
| 2-1 | 1.63 (7.25) | 1.72 (7.65) | +0.09 (+0.40) |
| 2-2 | 1.61 (7.16) | 2 (8.90) | +0.39 (+1.73) |
| Comparative Sample A | 2.77 (12.32) | 4.36 (19.39) | +1.59 (+7.07) |

EXAMPLE 3

Preparation of Backside Conductive Antistatic Coatings:

This example compares the use of the polymeric materials of this invention with silicone oil to provide protective topcoat layers with similar force values (similar friction) across different density patches.

Backside Undercoat Formulation:

A backside undercoat conductive layer formulation was prepared by mixing the following materials:

| | |
|---|---|
| CELNAX ® CX-Z401M (containing 40% active solids) | 50.0 parts |
| MEK | 375 parts |
| VITEL ® PE-2700B LMW | 4.39 parts |
| CAB 381-20 | 17.5 parts |

Backside Topcoat Formulation:

A backside topcoat formulation was prepared by mixing the following materials:

| | |
|---|---|
| MEK | 87.2 parts |
| CAB 381-20 | 11.0 parts |
| SYLOID ® 74X6000 | 0.14 parts |

The buried backside conductive layer formulation and backside topcoat formulations were coated onto one side of a 7 mil (178 μM) blue tinted poly(ethylene terephthalate) support. A precision multilayer coater equipped with an in-line dryer was used. The coating weight of the backside conductive layer was 0.05 g/ft$^2$ (0.54 g/m$^2$) and that of the backside topcoat layer was 0.4 g/ft$^2$ (4.3 g/m$^2$).

Thermographic Protective Layer Formulation:

The following protective layer formulations were prepared.

TABLE V

| Material | Sample 3-1 | Sample Comparative Sample B |
|---|---|---|
| Toluene | 26.19 g | 26.19 g |
| CERAMER ® 1608 | 0.41 g | 0.61 g |
| DC-550 | — | 0.20 g |
| VYBAR ® 103 | 0.41 g | — |
| ALBACAR ® 5970 | 0.55 g | 0.55 g |
| MEK | 20.21 g | 20.21 g |
| DESMORAPID ® PP (1%) | 1.52 g | 1.52 g |
| PIOLOFORM ® BS-18 | 3.84 g | 3.84 g |
| DESMODUR ® CB55N | 6.88 g | 6.88 g |
| Total | 60.00 g | 60.00 g |

Thermographic emulsion (prepared in Example 1) and protective layer formulations of this example were coated onto the 7 mil (178 μm) blue tinted polyethylene terephthalate support having the backside conductive antistatic layer prepared and coated as described in this example. A conventional, laboratory scale, dual-knife coater was used. Samples were dried in an oven at 185° F. (85° C.) for 4 minutes. The coating weight of the thermographic emulsion layer was 2.4 g/ft$^2$ (25.8 g/m$^2$). The coating weight of the protective layer was 0.4 g/ft$^2$ (4.3 g/m$^2$).

Thermographic materials of Samples 3-1 and 3-2 were tested to determine the force needed to transport the materials past a thermal printhead. Force measurements were carried out on these samples in the same manner as described in Example 1. The results, shown below in TABLE VI, demonstrate that the wax combination is preferred, and that combinations with silicone oils did not perform as well.

TABLE VI

| Sample | Dmin Force Pounds (Newtons) | Toe Force Pounds (Newtons) | Dmax Force Pounds (Newtons) |
|---|---|---|---|
| 3-1 | 3.25 (14.46) | 3.37 (14.99) | 2.42 (10.76) |
| Comparative Sample B | 7.11 (31.63) | 6.54 (29.09) | 3.71 (16.50) |

The invention has been described in detail with particular reference to certain preferred embodiments thereof, but it will be understood that variations and modifications can be effected within the spirit and scope of the invention.

We claim:

1. A non-photosensitive direct thermographic material comprising a support and on one or both sides thereof, one or more thermally sensitive imaging layers and an outermost non-thermally sensitive protective layer disposed over said one or more thermally sensitive imaging layers, said one or more thermally sensitive layers having in reactive association, a non-photosensitive source of reducible silver ions and a reducing agent for said reducible silver ions, and said outermost protective layer comprising:

(a) a solid polymer derived from one or more olefins and from one or more ethylenically unsaturated polymerizable carboxylic acids or esters or anhydrides thereof, and (b) a branched α-olefin polymer, and (c) optionally, an additional wax, wherein the total amount of component (a), component (b), and optionally component (c) is from about 0.1 to about 2.5 g/m$^2$.

2. The thermographic material of claim 1 wherein said outermost protective layer has a dry thickness of from about 0.1 to about 10 μm.

3. The thermographic material of claim 1 wherein said outermost protective layer comprises all three components (a), (b), and (c).

4. The thermographic material of claim 1 wherein said component (c) is a microcrystalline wax, carnauba wax, petronauba wax, paraffin wax, candelilla wax, or a linear low molecular weight polyethylene.

5. The thermographic material of claim 1 wherein said outermost protective layer further comprises a matting agent that comprises from about 0.2 to about 10 dry weight % of said outermost protective layer.

6. The thermographic material of claim 1 wherein said component (a) is a solid polymer that is derived from one or more α-olefins having 2 to 8 carbon atoms and from one or more ethylenically unsaturated polymerizable carboxylic acids or esters or anhydrides thereof having from 3 to 12 carbon atoms.

7. The thermographic material of claim 6 wherein said component (a) is a solid polymer derived from ethylene, propylene, or both, and from maleic acid, ethyl maleic acid, propyl maleic acid, isopropyl maleic acid, fumaric acid, methylene malonic acid, glutaconic acid, itaconic acid, methyl itaconic acid, mesaconic acid, citraconic acid, an ester or anhydride or any of these, or a mixture thereof.

8. The thermographic material of claim 1 wherein said component (a) is a solid polymer represented by the following Structure (I):

(I)

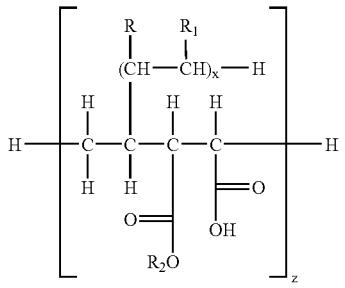

wherein R and $R_1$ individually represent hydrogen or an alkyl group having 1 to 10 carbon atoms, x is a number of from 9 to 75, $R_2$ is hydrogen or an alkyl group having 1 to 3 carbon atoms, and z is from about 5 to about 20.

9. The thermographic material of claim 8 wherein said component (a) is a maleic anhydride polyethylene, maleic acid anhydride polypropylene, isopropylmaleate polyethylene, or isopropylmaleate polypropylene graft copolymer.

10. The thermographic material of claim 1 wherein component (b) has a number average molecular weight of at least 300 and up to 10,000, a degree of branching of from about 4 to about 15, and a melting point or softening point of up to 120° C.

11. The thermographic material of claim 10 wherein component (b) has a number average molecular weight of from about 400 to about 5000, a degree of branching of from about 5 to about 10, and a melting point or softening point of from about 35 to about 110° C.

12. The thermographic material of claim 1 wherein component (b) is represented by the following Structure (II):

(II)

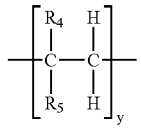

wherein $R_4$ is an alkyl group having 4 to 50 carbon atoms, $R_5$ is hydrogen or an alkyl group having 6 to 50 carbon atoms, and y is from 10 to 500.

13. The thermographic material of claim 1 wherein the weight ratio of component (a) to component (b) is from about 1:10 to about 10:1 and component (a) is present in an amount of from about 0.01 to about 1 g/m$^2$.

14. The thermographic material of claim 13 further comprising component (c) and wherein the weight ratio of component (a) to component (c) is from about 1:10 to about 10:1, and the weight ratio of component (b) to component (c) is from about 1:10 to about 10:1.

15. The thermographic material of claim 14 wherein the weight ratio of component (a) to component (b) is from about 1:2 to about 2:1, the weight ratio of component (a) to component (c) is from about 1:2 to about 2:1, and the weight ratio of component (b) to component (c) is from about 1:2 to about 2:1.

16. The thermographic material of claim 1 wherein said non-photosensitive source of reducible silver ions includes one or more silver carboxylates, one of which is silver behenate.

17. The thermographic material of claim 1 wherein said reducing agent composition comprises an aromatic di- or tri-hydroxy compound or mixtures thereof.

18. The thermographic material of claim 1 wherein said one or more thermally sensitive imaging layers further comprise one or more aliphatic or aromatic polycarboxylic acids.

19. A black-and-white, non-photosensitive direct thermographic material that comprises a transparent polymer support having on only one side thereof one or more thermally sensitive imaging layers and an outermost non-thermally sensitive protective layer over said one or more thermally sensitive imaging layers, said one or more thermally sensitive imaging layers comprising predominantly one or more hydrophobic binders, and in reactive association, a non-photosensitive source of reducible silver ions that includes one or more silver aliphatic carboxylates at least one of which is silver behenate, a reducing agent for said non-photosensitive source reducible silver ions comprising an aromatic di- and tri-hydroxy compound having at least two hydroxy groups in ortho- or para-relationship on the same aromatic nucleus or mixture thereof, and a conductive layer on the opposite side of said support, said outermost protective layer comprising a matting agent in an amount of from about 1 to about 10 weight % of the total dry weight of said outermost protective layer, and said outermost protective layer further comprising all three of the following components (a), (b), and (c):

(a) a polyolefin solid polymer having a molecular weight of about 700, an acid number of 160, a saponification number of 212, a penetration index at 25° C. of 3, a melting point of 78° C., and that is the reaction product of α-olefin with maleic anhydride and mono-isopropyl maleate, (b) a branched α-olefin polymer having a number average molecular weight of about 4400, a softening point of 74IC, and (c) a linear polyethylene wax having a weight average molecular weight of about 450 and a melting point of 81° C., wherein the weight ratio of component (a) to component (b) is from about 1:2 to about 2:1, the weight ratio of said component (a) to component (c) is from about 1:2 to about 2:1, and the weight ratio of component (b) to component (c) is from about 1:2 to about 2:1, and component (a) is present in an amount of from about 0.01 to about 1 $g/m^2$.

20. The thermographic material of claim 19 wherein said conductive layer comprises non-acicular metal antimonate particles composed of $ZnSb_2O_6$.

21. A method comprising imaging the direct thermographic material of claim 1 with a thermal imaging source to provide a visible image.

22. The method of claim 21 wherein said thermographic material comprises a transparent support and said image-forming method further comprises:

positioning said imaged thermographic material with the visible image thereon between a source of imaging radiation and an imageable material that is sensitive to said imaging radiation, and thereafter exposing said imageable material to said imaging radiation through the visible image in said imaged thermographic material to provide an image in said imageable material.

23. A method comprising imaging the thermographic material of claim 19 with a thermal imaging source to provide a visible image.

24. The method of claim 23 wherein said imaging is carried out using a thermal printhead and said thermographic material is moved in contact with and relative to said thermal printhead.

25. The method of claim 21 wherein the imaged direct thermo-graphic material is used for medical diagnostic purposes.

* * * * *